United States Patent [19]

Esterson

[11] 4,147,953

[45] Apr. 3, 1979

[54] CATHODE CONSTRUCTION FOR LINEAR BEAM TUBES

[75] Inventor: Maurice Esterson, Chelmsford, England

[73] Assignee: English Electric Valve Company Limited, Chelmsford, England

[21] Appl. No.: 754,001

[22] Filed: Dec. 27, 1976

[30] Foreign Application Priority Data

Dec. 29, 1975 [GB] United Kingdom ..... 52944/75

[51] Int. Cl.[2] ..... H01J 1/46; H01J 1/52; H01J 19/38

[52] U.S. Cl. ..... 313/299; 313/339; 313/349; 313/353; 313/454; 313/447

[58] Field of Search ..... 313/348, 299, 454, 452, 313/446, 447, 338, 339, 349, 353

[56] References Cited

U.S. PATENT DOCUMENTS

| | | | |
|---|---|---|---|
| 3,119,041 | 1/1964 | Harris | 313/338 X |
| 3,967,150 | 6/1976 | Lien et al. | 313/338 |
| 4,031,425 | 6/1977 | Ziegler et al. | 313/338 X |

*Primary Examiner*—Alfred E. Smith
*Assistant Examiner*—Charles F. Roberts
*Attorney, Agent, or Firm*—Diller, Ramik & Wight

[57] ABSTRACT

A linear beam tube is provided with a gridded electron gun in which a concave cathode surface is provided with concave channels from which electrons are emitted. The channels may be arranged as concentric annuli. In a preferred embodiment the channels extend radially outwards from the center of the cathode to minimize the effects of temperature distortion. The cathode is provided with a shadow grid and a control grid is spaced from and aligned therewith.

9 Claims, 7 Drawing Figures

CATHODE CONSTRUCTION FOR LINEAR BEAM TUBES

This invention relates to linear beam tubes and in particular to linear beam tubes of the kind having a gridded electron gun with a concave cathode surface in which a plurality of individual cathode emitting regions are formed, whereby the electron beam from the gun is formed of a plurality of subsidiary beams.

One example of a known tube of the above kind is to be found described in U.K. patent specification number, 1,400,668.

The present invention seeks to provide an improved linear beam tube of the above kind.

According to this invention a linear beam tube of the kind referred to is provided wherein the individual cathode emitting regions are formed by channels provided in the surface of said cathode. Said channels may consist of a series of concentric annular channels surrounding the axis of the tube. Typically four to six concentric circular channels would be provided.

Preferably however said channels extend radially outwards from the centre of said cathode, in which case preferably said channels are tapered in width and depth, each channel being shallower and narrower towards the centre of said cathode.

Normally, the channels are bordered, at least along their sides, by conductive material forming a shadow grid and a control grid which is closely spaced from the shadow grid. Said shadow grid may be formed of conductive material deposited on said cathode surface. Preferably said control grid corresponds in configuration to said shadow grid.

In one example in which channels extend radially from the centre of said cathode said shadow grid comprises a plurality of radially extending members, each radially extending member extending from the side of one to the side of the other of two adjacent channels.

Figure 1:
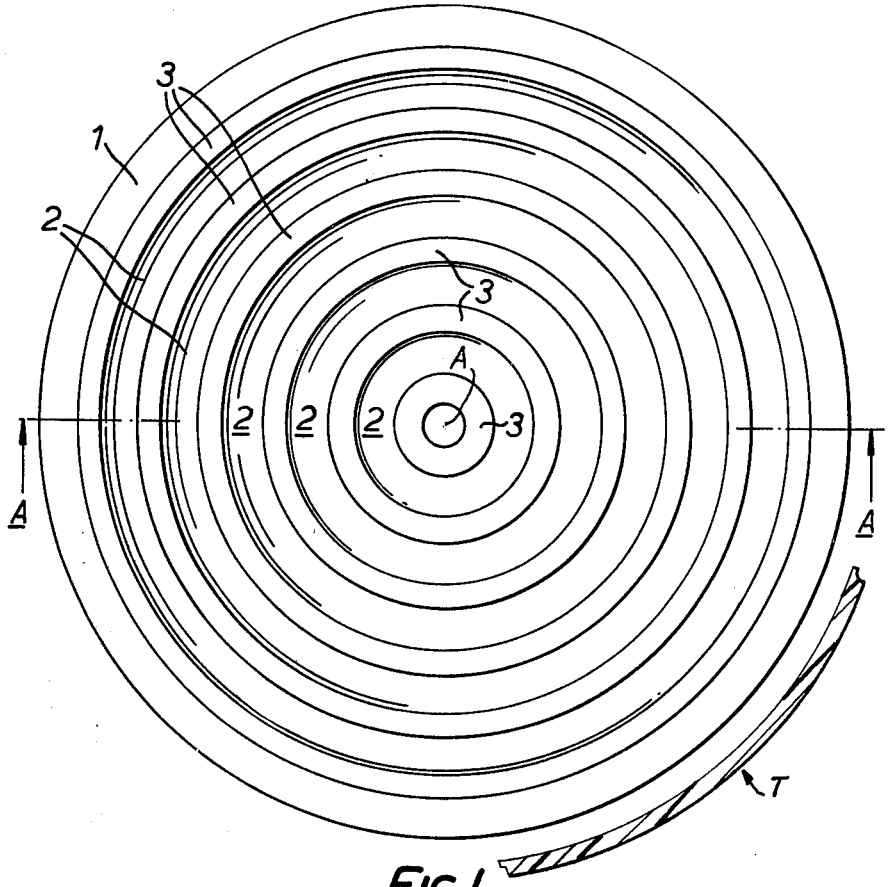
Figure 2:
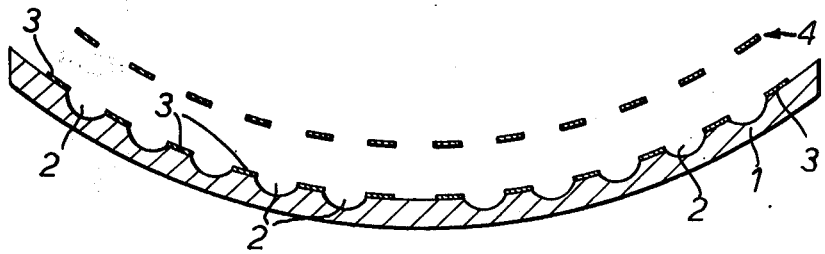

The invention is illustrated in and further described with reference to the accompanying drawings in which, FIG. 1 is a schematic plan view of the cathode of one linear beam tube in accordance with the present invention, FIG. 2 is a section along the line AA in FIG. 1 and showing in addition a control electrode used with the cathode of FIG. 1.

Figure 3:
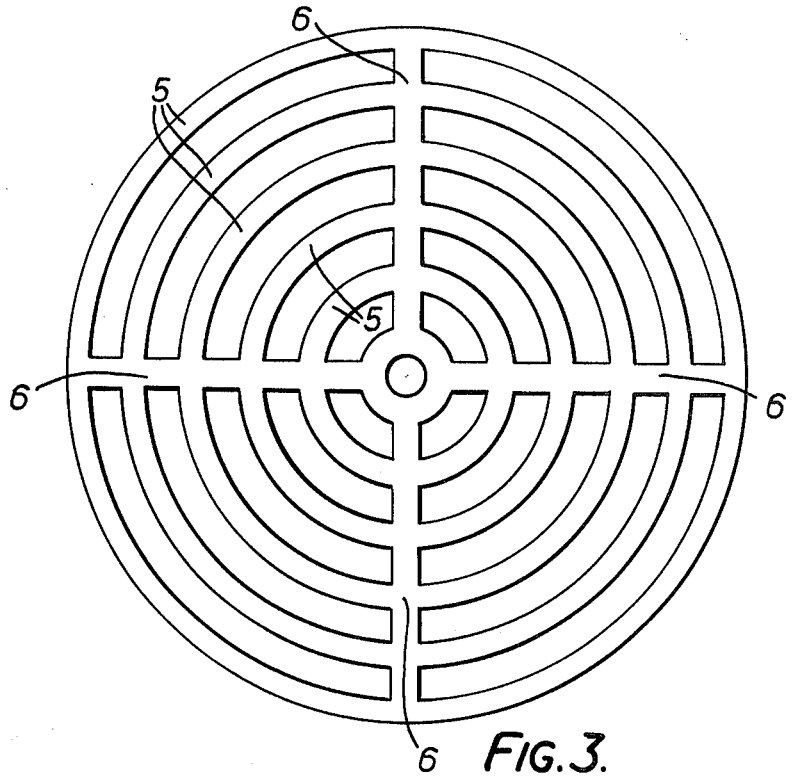
Figure 4:
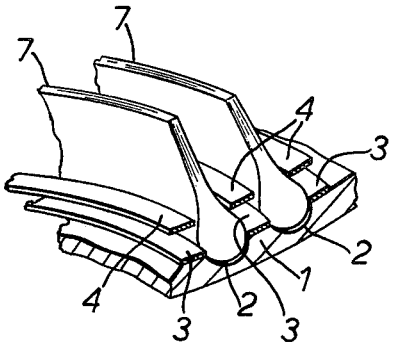
Figure 5:
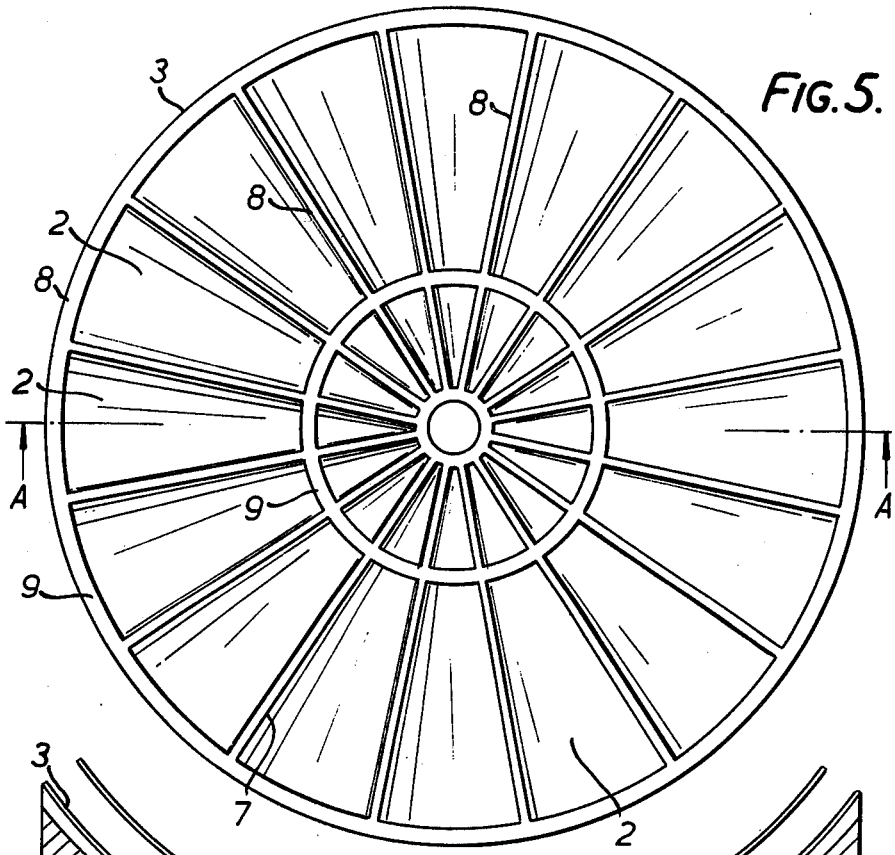
Figure 6:
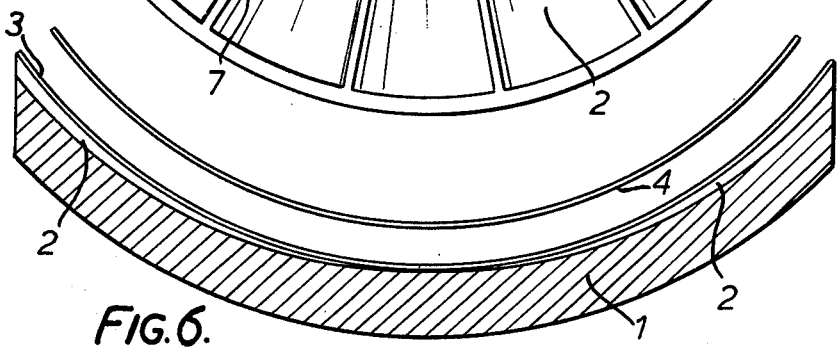
Figure 7:
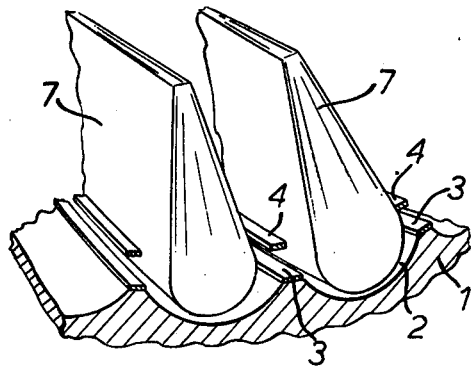

FIG. 3 is a plan view of the control electrode shown in FIG. 2,

FIG. 4 is a part cut away perspective view illustrating the cathode of FIG. 2 in operation, FIG. 5 is a plan view of the cathode of another linear beam tube in accordance with the present invention, FIG. 6 is a section along the line AA of FIG. 5 and showing in addition a control electrode used with the cathode of FIG. 5 and FIG. 7 is a part cut away perspective view illustrating the cathode arrangement of FIG. 6 in operation.

Referring to FIGS. 1 and 2, the electron gun of the linear beam tube T consists of a concave cathode 1 which has five concentric circular channels 2 milled into its surface and surrounding the axis A of the tube. Each channel is semi circular in cross section. Bordering each channel 2 is conductive material 3 which forms what is known as a shadow grid.

Spaced from the surface of the cathode 1 is a concave control grid 4. A plan view of the control grid 4 in this example is shown in FIG. 3. This consists of a number of concentric circular electrodes 5, the whole corresponding in configuration and dimension to the shadow electrode 3 formed on the surface of the cathode. The component circular electrodes 5 forming the grid 4 are supported by bridge pieces such as 6.

With an electron gun as described with reference to FIGS. 1 to 3, the beamlets which make up the electron beam from the gun are in the form of concentric cylinders as represented at 7 in FIG. 4.

Compared with a gridded electron gun as described in U.K. specification number 1,400,668, the manufacture of the cathode is simplified. However, like the prior gun referred to, the gridded electron gun described with reference to FIGS. 1 to 4 suffers from the disadvantage that due to radial expansion of the control grid with rise in temperature, misalignment of the grids and emitting regions can occur during operation.

The effects of such expansion are reduced with a construction as now to be described with reference to FIGS. 5 to 7 in which the individual cathode emitting regions are channels extending radially outwards.

Referring to FIGS. 5 and 6, the cathode 1 is again concave, but in this case the channels 2 extend radially outwards from the centre of the cathode. Each channel 2 is tapered both in width and depth, the channels becoming shallower and narrower towards the centre of the cathode 1. Each channel is again bounded by parts of a shadow grid 3.

The shadow grid consists of radially extending members 8 each extending from the side of one to the side of the other of two adjacent radially extending channels and three concentric annuli 9 forming bridges where they cross channels 2. These concentric annuli 9 act to support the radially extending members 8. The control grid 4, not shown in FIG. 5, corresponds in plan view to the shadow grid 3 shown in FIG. 5 and is aligned therewith. In operation, a plurality of wedge shaped subsidiary beams are provided as represented at 7 in FIG. 7. It will be noted that the subsidiary beams are wedge shaped, bounded by planes through the gun axis and the outside surfaces taper towards the gun axis.

With a gridded gun as described with reference to the above FIGS. 5 to 7 it will be noted that radial expansion of the control grid 4 due to a rise in temperature has little or no effect upon the alignment of the grids and cathode emitting regions since the latter extend in the direction of expansion.

I claim:

1. A linear beam tube including a gridded electron gun with a concave cathode surface in which a plurality of individual cathode emitting regions formed by channels are provided, whereby the electron beam from the gun is formed of a plurality of subsidiary beams and wherein said channels consist of a series of concentric annular channels surrounding the axis of the tube.

2. A tube as claimed in claim 1 and wherein from four to six concentric circular channels are provided.

3. A linear beam tube including a gridded electron gun with a concave cathode surface in which a plurality of individual cathode emitting regions formed by channels are provided, each channel being of semi-circular concave cross section whereby the electron beam from the gun is formed of a plurality of convergent subsidiary beams, said channels extending radially outwards from the center of said cathode.

4. A tube as claimed in claim 3 wherein said channels are bordered, at least along their sides, by conductive material forming a shadow grid, said tube including a control grid which is closely spaced from the shadow grid, and wherein said shadow grid comprises a plurality of radially extending members, each radial extending member extending from the side of one to the side of the other of two adjacent channels.

5. A linear beam tube including a gridded electron gun with a concave cathode surface in which a plurality of individual cathode emitting regions formed by channels are provided, whereby the electron beam from the gun is formed of a plurality of subsidiary beams, said channels extending radially outwards from the center of said cathode, and said channels being tapered in width and depth, each channel being shallower and narrower towards the center of said cathode.

6. A tube as claimed in claim 1 and wherein the channels are bordered, at least along their sides, by conductive material forming a shadow grid, and said tube including a control grid which is closely spaced from the shadow grid.

7. A tube as claimed in claim 6 and wherein said shadow grid is formed of conductive material deposited on said cathode surface.

8. A tube as claimed in claim 6 and wherein said control grid corresponds in configuration to said shadow grid.

9. In a linear beam tube, the combination of:

a cathode having a concave surface provided with a plurality of cathode emitting regions, each region being in the form of a channel in said concave surface;

conductive means on said concave surface bordering said channels, at least along their sides, for forming a shadow grid; and a control grid corresponding in configuration and dimensions to said shadow grid, said control grid being closely spaced from said shadow grid and being aligned therewith;

said channels extending radially outwards from the center of said concave surface whereby misalignments of said grids and said emitting regions due to rise in temperature is significantly reduced, each channel being of concave cross section.

* * * * *